United States Patent [19]

Sakakiyama

[11] Patent Number: 4,510,903

[45] Date of Patent: Apr. 16, 1985

[54] SYSTEM FOR REGULATING THE IDLE SPEED OF AN INTERNAL COMBUSTION ENGINE

[75] Inventor: Ryuzo Sakakiyama, Tokyo, Japan

[73] Assignees: Fuji Jukogyo Kabushiki Kaisha, Tokyo, Japan; Fuji Jukogyo Kabushiki Kaisha, Tokyo, Japan

[21] Appl. No.: 557,094

[22] Filed: Dec. 1, 1983

[30] Foreign Application Priority Data

Dec. 3, 1982 [JP] Japan ..... 57-212445

[51] Int. Cl.[3] ..... F02D 11/10

[52] U.S. Cl. ..... 123/339; 123/352; 290/40 R

[58] Field of Search ..... 290/40 R, 40 A, 40 B, 290/40 C; 123/339, 352

[56] References Cited

U.S. PATENT DOCUMENTS

| | | | |
|---|---|---|---|
| 3,192,394 | 6/1965 | Teter | 290/51 |
| 3,789,229 | 1/1974 | Jackson | 290/40 B |
| 4,402,288 | 9/1983 | Ohgami | 123/339 |
| 4,423,307 | 12/1983 | Kondo | 290/40 B |

*Primary Examiner*—Ronald B. Cox

*Attorney, Agent, or Firm*—Martin A. Farber; Martin A. Farber

[57] ABSTRACT

A system for regulating the idle speed of an internal combustion engine. The engine has an alternator, and a voltage regulator having a Darlington circuit connected between an end of a field winding of the alternator and the ground. The Darlington circuit is responsive to the output voltage of the alternator for controlling the current flowing a field winding of the alternator so as to regulate the output voltage of the alternator. The system has an integrator for integrating the voltage across the Darlington circuit and a comparator for comparing the output voltage of the integrator with a reference voltage and for producing an output voltage dependent on the comparison.

A solenoid is operatively connected to a throttle valve of the engine.

A switching transistor circuit is provided to respond to the output voltage of the comparator for allowing the current to pass through the solenoid and for actuating the throttle valve to regulate the idle speed.

10 Claims, 1 Drawing Figure

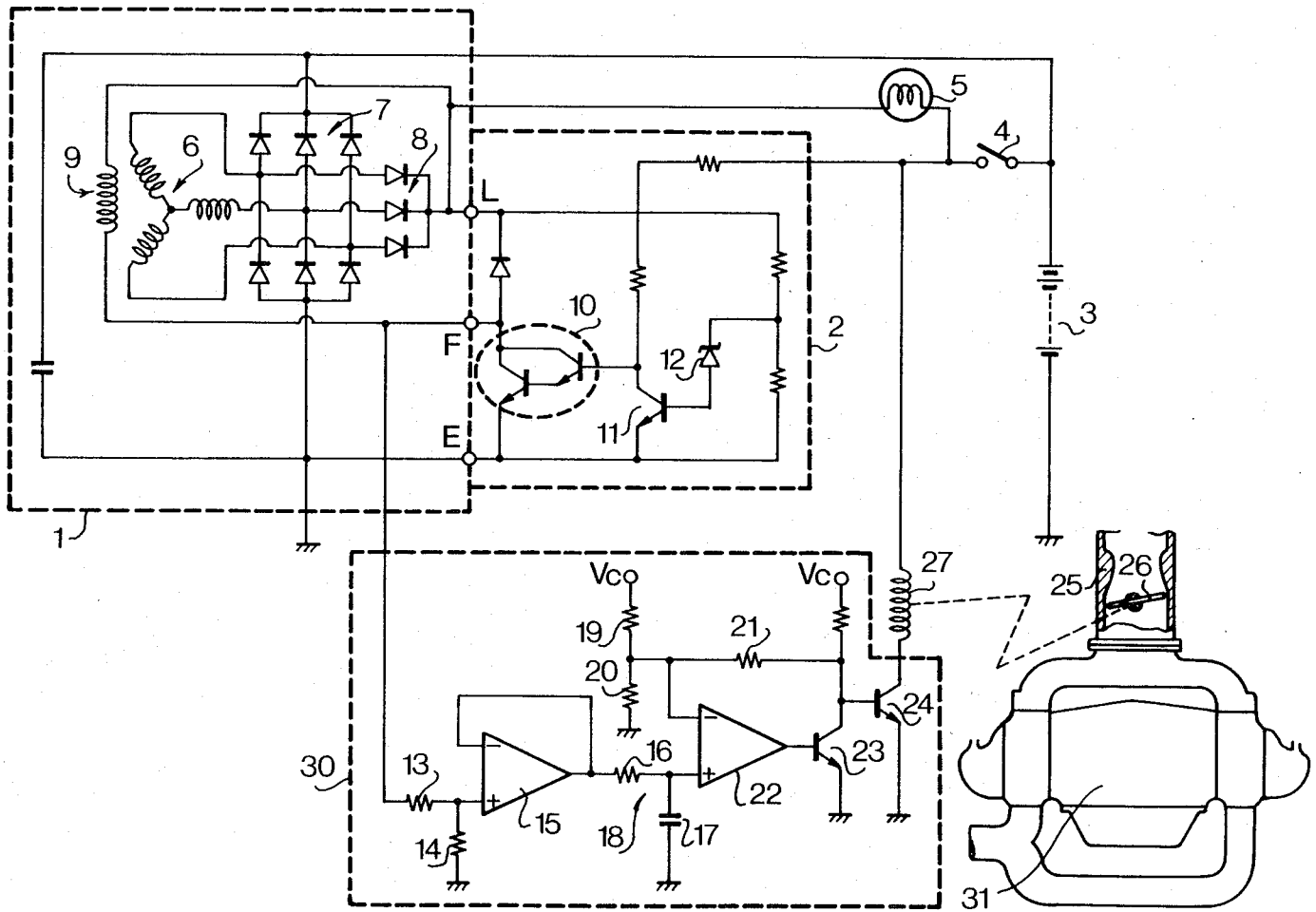
1
2
3
4
5
6
7
8
9
10
11
12
13
14
15
16
17
18
19
20
21
22
23
24
25
26
27
30
31
L
F
E
Vcc
Vcc

SYSTEM FOR REGULATING THE IDLE SPEED OF AN INTERNAL COMBUSTION ENGINE

BACKGROUND OF THE INVENTION

The present invention relates to a system for regulating the idle speed of an internal combustion engine mounted on a vehicle, and more particularly to a regulating system for slowdown of the idle speed due to an increase of electric load such as head lights and other devices.

A conventional regulating system is provided with a feedback control circuit comprising an engine speed sensor, a comparator for comparing the output of the sensor with a reference value and for producing an output, and an actuator responsive to the output of the comparator for actuating a throttle valve of the engine or a control valve provided in a bypass around the throttle valve to regulate the idle speed to a predetermined speed. Japanese Laid Open Patent Application Nos. 54-79324 and 55-160138 disclose systems provided with such control valves. Such a system can not regulate the small variation of idle speed caused by electric load, because the engine speed sensor does not respond to such a small variation of idle speed.

On the other hand a voltage regulator of an alternator mounted on the vehicle causes the alternator to operate to increase the alternator voltage when the alternator voltage tends to drop due to the increase of electric load. Such a regulating operation is performed by controlling the amount of current flowing through the field winding of the alternator. Therefore, if idle speed decreases with the increase of electric load, the current flowing through the field windings.

SUMMARY OF THE INVENTION

The present invention uses the variation of the current flowing through the field windings for regulating the idle speed of an engine.

The object of the present invention is to provide a system which may securely regulate the idle speed when the idle speed decreases with electric load.

According to the present invention, there is provided a system for regulating the idle speed of an internal combustion engine having a throttle or other idle speed regulating valve, an alternator, and a voltage regulator having a control circuit responsive to the output voltage of said alternator for controlling the current flowing through a field winding of said alternator so as to regulate the output voltage of said alternator, comprising; an integrator for integrating the voltage across said control circuit; a comparator for comparing the output voltage of said integrator with a reference voltage and for producing an output voltage dependent on the comparison; a solenoid operatively connected to said valve for actuating the valve; switching means responsive to said output voltage of said comparator for allowing the current to pass through the solenoid and for actuating said valve to regulate the idle speed, and a resistor for providing hysteresis effect on said comparator in order to prevent the hunting of the operation of said solenoid.

The other objects and features of this invention will be apparently understood from the following description with reference to the accompanying drawings hereinafter.

BRIEF DESCRIPTION OF DRAWINGS

The single drawing shows an idle speed regulating system according to the present invention.

DETAILED DESCRIPTION OF THE PREFERRED EMBODIMENT

Referring to the drawing, an alternator 1 operates to charge a battery 3 and to light a charge lamp 5 by the closing of an ignition switch 4. A voltage regulator 2 is attached to the alternator 1. The alternator 1 comprises stator windings 6, main rectifier diodes 7 for charging the battery 3, a field winding 9, and auxiliary diodes 8 for supplying a field current. The voltage regulator 2 comprises a Darlington circuit 10 connected between an end terminal F of the field winding 9 and a ground terminal E, a transistor 11 connected between the base of the transistor of the Darlington circuit 10 and the ground terminal E, and a zener diode 12 connected between the terminal L of the auxiliary diodes 8 and the base of the transistor 11.

When the alternator voltage exceeds a predetermined value, the zener diode 12 reaches its breakdown state and the transistor 11 becomes conductive. Thus, the conductivity of the Darlington circuit 10 decreases, thereby to decreasing the field current flowing through the field winding 9. As a result, the alternator voltage drops.

On the contrary, if the alternator voltage drops below the predetermined value, the transistor 11 is off, so that the conductivity of the Darlington circuit 10 rises. Therefore, the field current increases to increase the alternator voltage. Thus, the alternator voltage, that is the battery voltage is maintained at the predetermined value.

It will be seen that the voltage between the terminals F and E, that is the voltage across the Darlington circuit 10 varies with the variation of the battery voltage owing due to electric load. The present invention uses the voltage variation across the Darlington circuit 10 as a signal representing the idle speed.

An idle speed regulator circuit 30 according to the present invention has an opamp 15 for the conversion of impedance, the non-inverting input of which is applied with the voltage at the terminal F through a voltage divider comprising resistors 13 and 14. The output of the opamp 15 is applied to a non-inverting input of a comparator 22 comprising an opamp through an integrator 18 comprising a resistor 16 and a capacitor 17, so that average voltage is applied to the comparator 22. The inverting input of the comparator 22 is applied with a reference voltage by resistors 19, 20 and 21 from terminals Vc. The output of the comparator 22 is connected to a base of a transistor 23, the collector of which is in turn connected to a base of a transistor 24. The transistor 24 is connected to a solenoid 27 in series to energize the solenoid. The solenoid 27 is operatively connected to a throttle valve 26 of a carburetor 25 of an engine 31 so as to actuate the throttle valve 26.

In operation, when battery voltage is at the predetermined value, the average voltage at the non-inverting input of the comparator 22 is higher than the reference voltage at the inverting input thereof. Accordingly, transistor 23 is on and transistor 24 is off, so that the solenoid 27 is not energized. When the voltage at the terminal F decreases below a predetermined value, which represents a decrease of the idle speed, the voltage at the non-inverting input of the comparator 22 becomes lower than the reference voltage. Therefore, the transistor 23 is turned off and hence the transistor 24 becomes conductive. Thus, the solenoid 27 is energized to open the throttle valve 26. Thus, the idle speed is increased to compensate the decrease of the alternator voltage. The resistor 21 provides a hysteresis in the operation of the comparator 22 in order to prevent the hunting of the operation of the solenoid 27.

The system of the present invention operates to regulate the idle speed in dependency on the drop of battery voltage, even if electric load does not increase. On the contrary, even if electric load increases, the regulation of idle speed is not carried out unless the battery voltage drops. Thus, the system does not operate in vain but positively regulates the idle speed in dependency on the battery voltage, that is the alternator voltage. Since no sensor for detecting the engine speed is provided, the circuit is simplified in construction.

Although the above described system is adapted to control the throttle valve, the present invention may be applied to a system for controlling a control valve provided in a bypass around the throttle valve.

While the presently referred embodiments of the present invention have been shown and described, it is to be understood that this disclosure is for the purpose of illustration and that various charges and modifications may be made without departing from the spirit and scope of the invention as set forth in the appended claims.

What is claimed is:

1. A system for regulating the idle speed of an internal combustion engine having a throttle valve, an alternator, and a voltage regulator having a control circuit responsive to the output voltage of said alternator for controlling the current flowing through a field winding of said alternator so as to regulate the output voltage of said alternator, comprising:

means comprising an integrator for integrating the voltage across said control circuit;

means comprising a comparator for comparing the output voltage of said integrator with a reference voltage and for producing an output voltage dependent on the comparison;

means comprising a solenoid operatively connected to said throttle valve for actuating the throttle valve;

switching means responsive to said output voltage of said comparator for allowing current to pass through the solenoid and for actuating said throttle valve to regulate the idle speed, and means comprising a resistor for providing hysteresis effect on said comparator in order to prevent hunting of the operation of said solenoid.

2. A system for regulating the idle speed of an internal combustion engine having a control valve for regulating the speed of the engine, an alternator, and a voltage regulator having a control circuit responsive to the output voltage of said alternator for controlling the current flowing through a field winding of said alternator so as to regulate the output voltage of said alternator, comprising:

means comprising an integrator for integrating the voltage across said control circuit;

means comprising a comparator for comparing the output voltage of said integrator with a reference voltage and for producing an output voltage dependent on the comparison;

means comprising a solenoid operatively connected to said control valve for actuating the control valve;

switching means responsive to said output voltage of said comparator for allowing current to pass in the solenoid and for actuating said control valve to regulate the idle speed, and means comprising a resistor for providing hysteresis effect on said comparator in order to prevent the hunting of the operation of said solenoid.

3. The system according to claim 1 wherein said control circuit comprises a Darlington circuit connected between an end of said field winding and the ground.

4. The system according to claim 1 wherein said comparator comprises an opamp.

5. The system according to claim 1 wherein said integrator comprises a resistor and a capacitor.

6. The system according to claim 1, wherein said switching means comprises a transistor circuit.

7. The system according to claim 1, wherein said control circuit includes current varying means serially connected with said field winding for varying the amount of current flow through said field winding, and said integrator integrates the voltage across said current varying means.

8. The system according to claim 7, wherein said current varying means is a Darlington circuit.

9. The system according to claim 2, further comprising an induction passage communicating with the engine, a throttle valve provided in said induction passage, and a bypass around said throttle valve, said control valve is provided in said bypass.

10. The system according to claim 4, wherein said resistor is connected between an input of said comparator applied with said reference voltage and said switching means.

* * * * *